United States Patent [19]

Hama et al.

[11] 4,448,037

[45] May 15, 1984

[54] COMBINED AIR CONDITIONING AND HOT WATER SERVICE SYSTEM

[75] Inventors: Hiroaki Hama; Masami Imanishi, both of Wakayama; Yasuyuki Funahashi, Kainan; Seiichi Kato, Wakayama, all of Japan

[73] Assignee: Mitsubishi Denki Kabushiki Kaisha, Tokyo, Japan

[21] Appl. No.: 459,120

[22] Filed: Jan. 19, 1983

[30] Foreign Application Priority Data

| | | | |
|---|---|---|---|
| Jan. 29, 1982 | [JP] | Japan | 57-14495 |
| Jan. 29, 1982 | [JP] | Japan | 57-14496 |
| Jan. 29, 1982 | [JP] | Japan | 57-14497 |
| Jan. 29, 1982 | [JP] | Japan | 57-14498 |

[51] Int. Cl.[3] ..... F25D 17/02; G05D 23/00

[52] U.S. Cl. ..... 62/188; 62/231; 62/238.7; 237/2 B

[58] Field of Search ..... 237/2 B; 62/238.6, 238.7, 62/231, 325, 188

[56] References Cited

U.S. PATENT DOCUMENTS

| | | | |
|---|---|---|---|
| 2,241,070 | 5/1941 | McLenegan | 237/2 B |
| 3,523,575 | 9/1970 | Olivieri | 62/238.6 |

FOREIGN PATENT DOCUMENTS

| | | |
|---|---|---|
| 5712938 | 1/1976 | Japan . |
| 5650168 | 6/1976 | Japan . |

*Primary Examiner*—William E. Wayner
*Assistant Examiner*—J. Sollecito
*Attorney, Agent, or Firm*—Leydig, Voit, Osann, Mayer and Holt, Ltd.

[57] ABSTRACT

Described is a cooling/heating and hot water service system making use of a single heat source apparatus. The system includes a heat pump chiller designed to perform cyclic operations of heating and cooling, a heat exchanger unit having a heat exchanger adapted for supplying hot water and a water reservoir. The operating time zone for storage of hot water and the operating time zone for heating and cooling the room are set by a first program timer while the operating time zone for servicing hot water is set by a second program timer.

In this manner, the cooperating time zone of the system is divided into the operating time zone for storage of hot water and the operating time zone for heating and cooling, and the operation of storage of hot water is effected during the time of the day that heating or cooling of the room is unnecessary while servicing of hot water is effected during the time of operation of heating or cooling the room, with resultant improvement in the operating rate of the unit and more efficient heating/cooling and servicing of hot water.

4 Claims, 3 Drawing Figures

COMBINED AIR CONDITIONING AND HOT WATER SERVICE SYSTEM

BACKGROUND OF THE INVENTION

This invention relates to a combined air conditioning (heating/cooling) and hot water service system or unit in which hot or cold water from a heat pump type chiller unit is employed not only for heating or cooling the room but also for servicing of hot water.

A certain type of such combined system or unit makes use of a hot water servicing heat exchanger in the refrigerant system of the heat pump type chiller unit in order to service hot water simultaneously with the heating or cooling the room. Such a system gives rise to a complicated refrigerant cycle and an increase in the number of brazing points thus frequently causing gas leakage in the refrigerant cycle. In addition, it is necessary to provide separate heat exchangers for heating, cooling and servicing of hot water in the refrigerant cycle of the heat pump type chiller unit. The result is an increased volume of the refrigerant charged into the system and generation of excess refrigerant depending on prevailing operational conditions thus frequently causing troubles due to such excess refrigerant such as liquid-back into the compressor. Moreover, when the room heating and servicing of hot water are effected simultaneously, the heating capacity may fluctuate with prevailing hot water service needs thus interfering with satisfactory room heating. Meanwhile, on most occasions, the heating or cooling operation is not continued all day long and hence there is a time zone the heat pump type chiller unit is not in operation in the manner known per se.

SUMMARY OF THE INVENTION

In view of the foregoing, the operating time zone is divided, in accordance with the present invention, into a hot water storage time zone and a heating/cooling time zone, and the operation for storage of hot water is effected during the time of the day that heating or cooling is unnecessary, while the operation for servicing of hot water is effected simultaneously with room heating-/cooling operation, with the consequent improvement in the operating rate of the unit and more efficient heating/cooling and servicing of hot water.

DESCRIPTION OF THE PREFERRED EMBODIMENT

Figure 1:
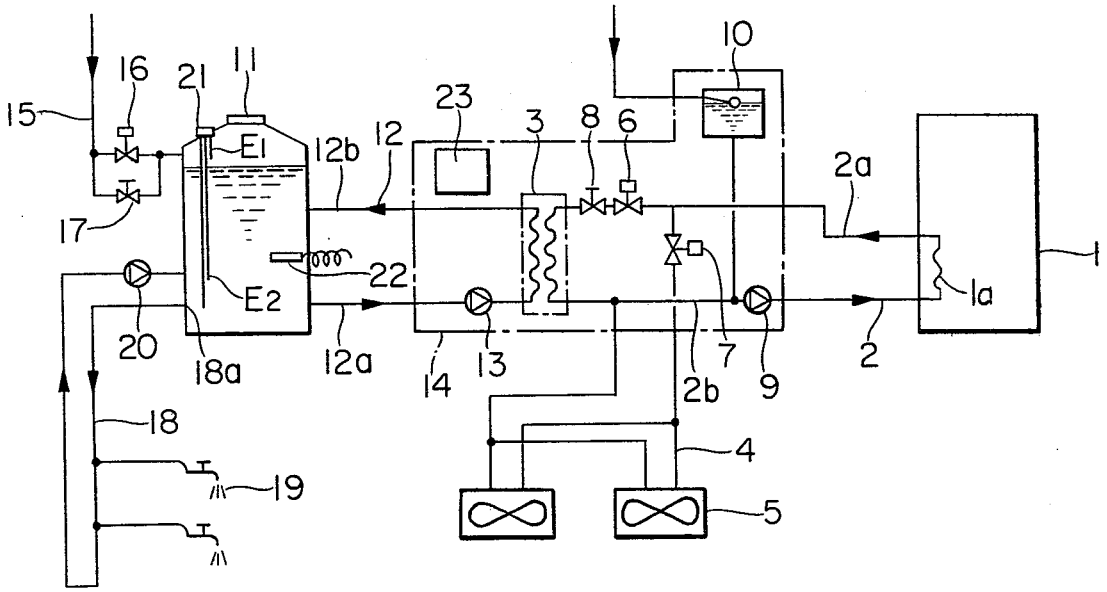
FIG. 1 is a schematic overall view of the combined heating/cooling and hot water servicing unit according to a preferred embodiment of the present invention.

FIG. 1 is a diagram showing the overall construction of a preferred embodiment of the present invention. In this Figure, the numeral 1 designates a heat pump type chiller unit having a conventional refrigerating cycle with a built-in four-way valve, not shown, for switching from the heating cycle to the refrigerating cycle or vice versa. The numeral 2 designates a water circuit connected to a water-side heat exchanger 1*a*, of the chiller unit 1, and the numeral 3 a heat exchanger provided to the water circuit 2 and designed for supplying hot water. The numeral 4 designates an air conditioning or heating/cooling circuit connected across an outward passage 2*a* and a return passage 2*b* of the water circuit 2 and in parallel with the heat exchanger 3, and having a fan coil unit 5. The numeral 6 designates a first electromagnetic valve provided between the heat exchanger 3 and a junction between the water circuit 2 and the heating/cooling circuit 4. The numeral 7 designates a second electromagnetic valve provided to the heating-/cooling circuit 4 and adapted for cooperating with the first valve 6 for heating/cooling operation and for hot water supply operation by selectively activating the fan coil unit 5 or the heat exchanger 3. Alternatively, a three-way electromagnetic valve may be provided at a junction between the water circuit 2 and the heating-/cooling circuit 4 in place of the first and second electromagnetic valves 6, 7. The numeral 8 designates a manually operable valve mounted between the first valve 6 and the heat exchanger 3 for adjusting the flow resistance. The numeral 9 designates a primary heat source pump mounted between a junction between the water circuit 2 and the heating/cooling circuit 4 and an input to the water-side heat exchanger, not shown, of the chiller unit 1. The numeral 10 designates a tank connected at one end to the suction side of this pump and at the other to a water source. The numeral 11 designates a water reservoir, and the numeral 12 a water heating circuit adapted for connecting the reservoir 11 with the heat exchanger 3 and having its outward passage 12*a* connected to a lower portion of the reservoir 11 and a return passage 12*b* communicating with an upper portion of the reservoir 11. The numeral 13 designates a secondary heat source pump mounted in the outward passage of the water heating circuit 12 and cooperating with the components 3 and 6 through 10 for constituting a heat exchange unit 14. The numeral 15 designates a fresh water supply pipe connected at one end to a further water source, not shown, and at the other end to the upper portion of the reservoir 11, and having an electromagnetic valve 16. The numeral 17 designates a bypass valve connected in parallel with the valve 16. The numeral 18 designates a hot water supply circuit connected to the lower portion of the water reservoir 11 and having a hot water cock 19 and a hot water pump 20. The numeral 21 designates a level sensor for sensing the water level in the reservoir and operable between water levels E1 and E2. The numeral 22 designates a temperature sensor for sensing the temperature of hot water contained in the reservoir 11. The numeral 23 designates a control panel for mounting a control circuit such as described later and which is provided within the heat exchange unit 14.

Figure 2:
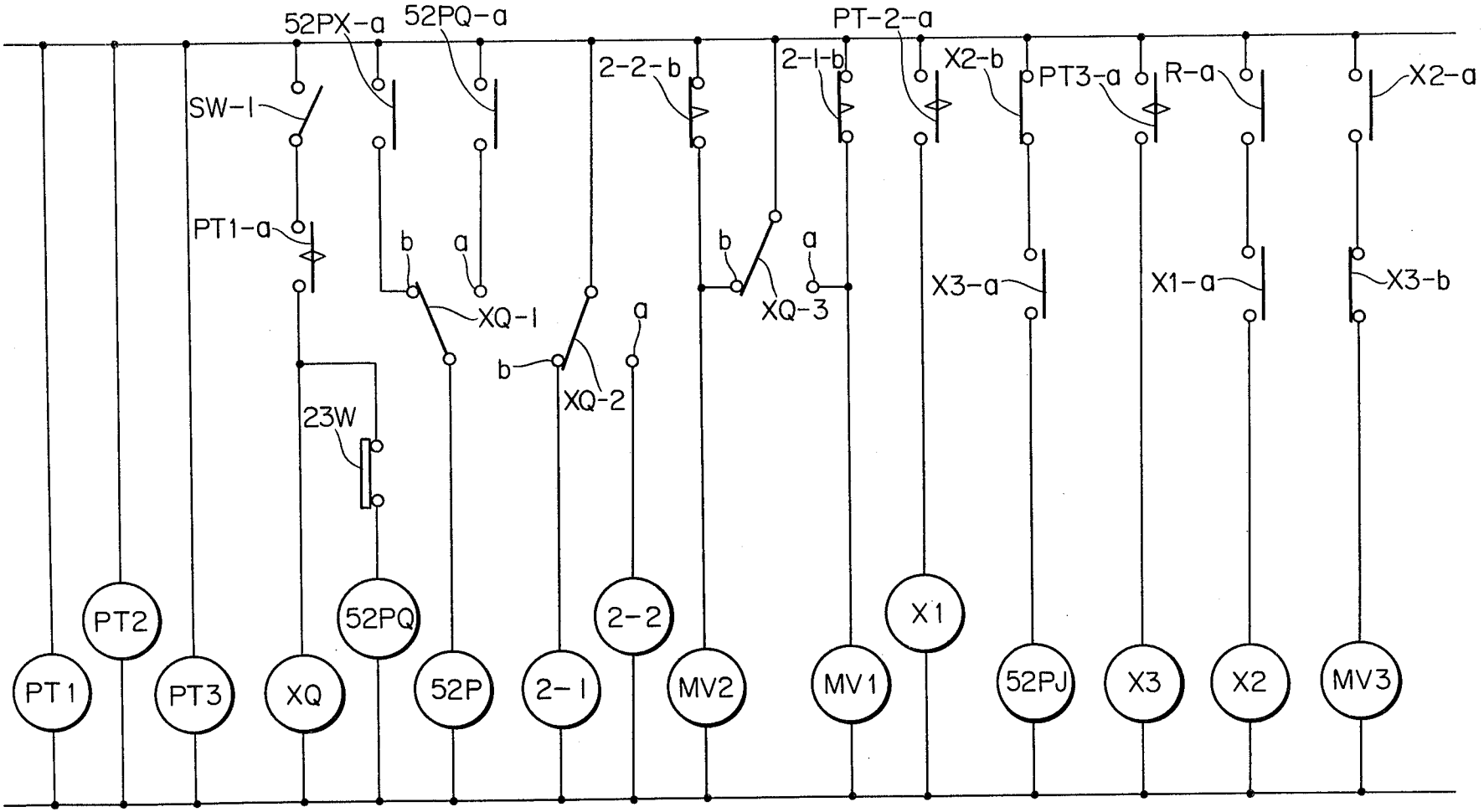
FIG. 2 is a connection diagram of an electrical system employed in the combined system shown in FIG. 1.
Figure 3:
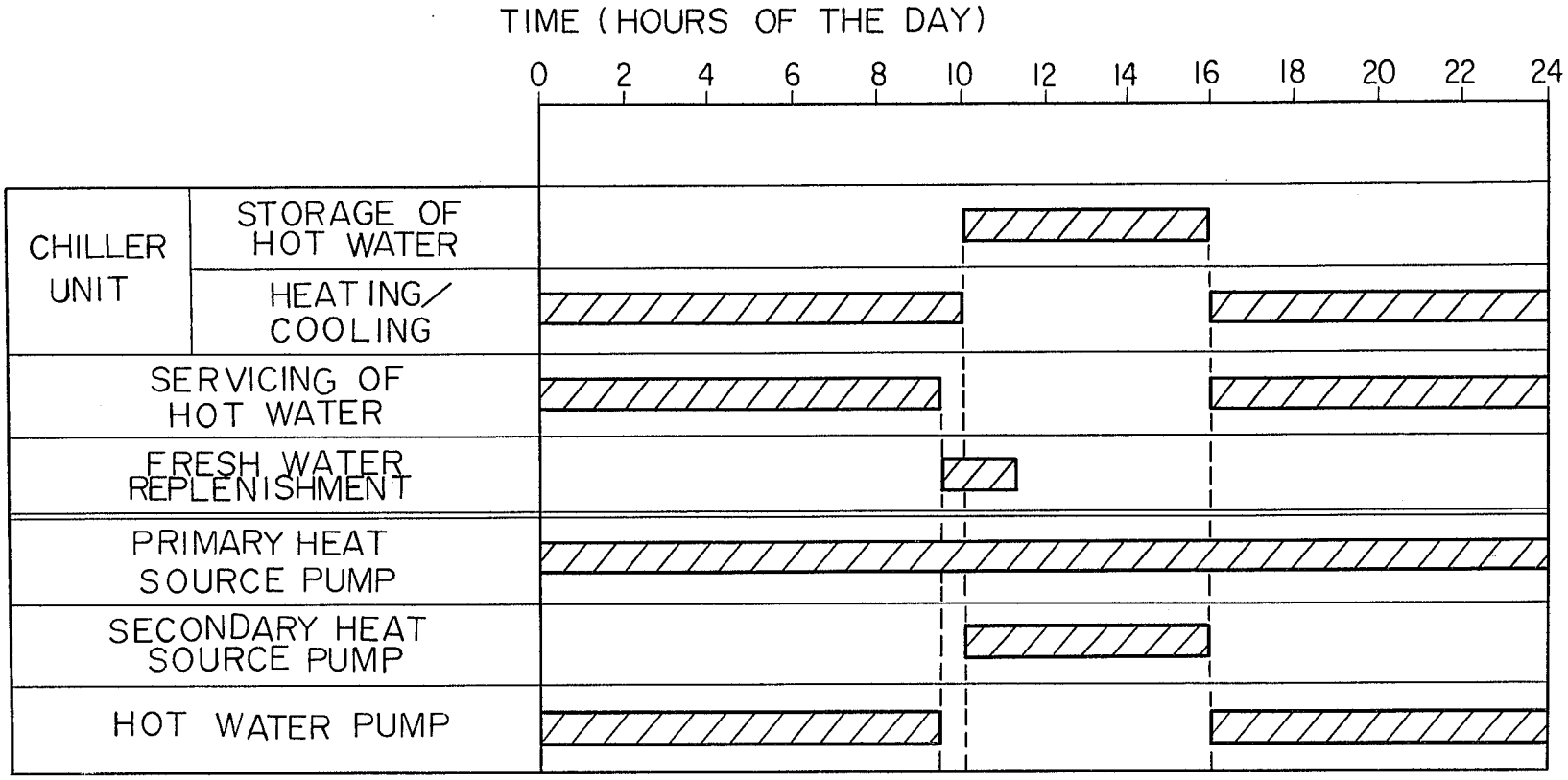
FIG. 3 is a chart showing the driving sequence for the system shown in FIG. 1.

The operation of the device is now described by referring to FIGS. 2 and 3 showing the electrical connection and operating sequence of the device. Referring first to hot water storage pattern, in FIG. 2, an operating switch, not shown, of the heat pump type chiller unit 1 is activated for closing a relay contact 52PX-a of a relay, not shown, of the chiller unit 1. In this manner, a coil 52P of an electromagnetic contactor associated with the primary pump 9 is energized for setting the primary pump 9 into operation. At this time, a coil PT1 of a first program timer designed for setting the hot water storage time zone and air conditioning time zone, a coil PT2 of a second program timer designed for setting the fresh water replenishing time zone for the electromagnetic valve 16, and a coil PT3 of a third program timer designed for setting the operating time zone for hot water pump 20, are in energized states. An operating switch SW-1 of the heat exchanger unit 14 is then turned on. In the hot water storage time zone as shown in FIG. 3, a timer contact PT1-a of the first program timer is closed for energizing a relay coil XQ. At this time, provided that water temperature in the reservoir 11 is below a predetermined value and hence a contact 23W of the sensor 22 is closed, a coil 52PQ of an electromagnetic contactor associated with the secondary heat source pump 13 is also energized. Upon energization of the relay coil XQ, its movable contacts XQ-1, XQ-2 and XQ-3 are reverted from fixed contacts b to fixed contacts a. At this time, a coil MV1 associated with the first valve 6 is energized instantly for opening the valve 6, and a coil MV2 of the second valve 7 is deenergized with a certain delay for closing the valve 7, while the primary pump 9 continues its operation. In the water circuit 2, since the heat pump chiller unit 1 is in its heating cycle, hot water is supplied from the unit 1 into the water circuit 2 and conducted through the heat exchanger 3 by way of the first valve 6 and the manual valve 8 to be returned to the chiller unit 1 through the primary pump 9. It should be noted that, upon reversion of the contact XQ-2 of the relay coil XQ from the side b to the side a, a relay coil 2-2 is energized and its timer contact 2-2-b remains closed until lapse of a predetermined time such as ten seconds. This means that the second electromagnetic valve 7 remains open for the time interval such as ten seconds along with the first valve, the second valve 7 only being then closed. In the water heating circuit 12, fresh water is supplied from water reservoir 11 to the heat exchanger 3 through the secondary pump 13. In the heat exchanger 3, the water is subjected to heat exchange with hot water supplied from the chiller unit 1 to be elevated in temperature and returned to the reservoir 11. When the water temperature in the reservoir 11 has reached a predetermined value, the temperature sensor 22 is activated for opening the contact 23W and the second pump 13 comes to a stop to terminate the hot water storage operation.

Referring now to the air conditioning operating pattern, within the air conditioning time zone, the coil PT1 of the first program timer is activated for opening its timer contact PT1-a so that the coil 52PQ of the electromagnetic contactor associated with the secondary pump 13 is disenergized to halt the operation of the pump 13, while the contacts XQ-1, XQ-2 and XQ-3 of the relay coil XQ are reverted from the side a to the side b. Thus a timer contact 2-1-b associated with a relay coil 2-1 is opened after lapse of a predetermined time such as ten seconds so that the coil MV1 associated with the first valve 6 is deenergized with a certain time delay for closing the first valve 6, while the coil MV2 associated with the second valve 7 is energized instantly for opening the second valve 7 by the reverse of the procedure to that depicted hereinabove. The primary pump 9 is continuing its operation through the relay contact XQ-1 and a relay contact 52PX-a which remains closed. Thus the water circuit 2 acts as well-known water cooling-heating air conditioning circuit in which cool or no water supplied from the chiller unit 1 is conveyed through the second electromagnetic valve 7 and the fan coil unit 5 for cooling or heating the room and returned through the primary heat source pump 9 to the chiller unit 1.

The heat pump type chiller unit 1 has a manually operable cooling/heating changeover switch, not shown, which is positioned during summer in abutment with a cooling contact for cooling through deenergizing the cooling/heating cycle changeover four-way valve, not shown, and positioned during winter in abutment with a heating contact for heating through energizing said four-way valve. By operation of this changeover switch, not shown, the unit 1 is maintained in the cooling cycle during the hot season and in the heating cycle during the cold serason. Thus, in case of transition from the hot water storage operation to the cooling operation, the contact PT1-a of the first program timer coil PT1 is opened for deenergizing the relay coil XQ. In conjuntion therewith, a contact, not shown, of the relay coil XQ connected in parallel with the heating-/cooling changeover switch, not shown, is opened, so that the four-way valve, not shown, is deenergized for switching the chiller unit 1 from the heating cycle to the cooling cycle. In the event of transition from hot water storage operation to room heating operation, the relay coil XQ is deenergized by the first program timer as described hereinabove, so that the contact, not shown, of the relay coil XQ connected in parallel with the heating/cooling changeover switch, not shown, is opened. However, the chiller unit 1 is maintained in the heating cycle because the four-way valve, not shown, remains activated through the heating/cooling changeover switch.

The time zone that hot water is available is set by the third program so as to be coincident with the time zone that the unit is set for air conditioning. Therefore, the coil PT3 of the third program timer is activated for closing its timer contact PT3-a so that a relay coil X3 is energized and an electromagnetic contactor 52PJ associated with the hot water pump 20 is also energized through a contact X2-b of the relay coil X2. Therefore, the hot water pump 20 is set into operation, so that heated water in the reservoir 11 is readily available from the hot water cock 19.

The time zone that fresh water is replenished into the reservoir 11 is set on the second program timer to directly follow the time zone that hot water is available from the hot water cock. Therefore, during this time zone, the coil PT2 of the second program timer is activated for closing its timer contact PT2-a so that the relay coil X1 is energized and the relay contact X1-a closed. When the hot water in the reservoir 11 is at an intermediate level (i.e. intermediate the levels E1 and E2 in FIG. 1), it is sensed by the level sensor 21 which outputs a signal for closing the contact R-a of a relay coil X2. Therefore, the relay coil X2 is energized for closing its contact X2-a so that the coil MV3 of the valve 16 is energized for opening the valve 16 for replenishing fresh water into the reservoir 11. Since the contact X2-b of the relay coil X2 is opened at this time, the coil 52PJ of the electromagnetic contactor associated with the hot water pump 20 is deenergized and the operation of the hot water pump 20 may cease positively. When the reservoir 11 is completely filled with fresh water (i.e. to the level E1 in FIG. 1), it is sensed by the sensor 21 which outputs a signal for opening a contact R-a of the relay coil X2. In this manner, the valve 16 is closed for terminating the water replenishing operation into the reservoir 11.

When the hot water in the reservoir 11 has become depleted (as indicated by the level E2 in FIG. 1) during the time that hot water is available from the cock 19, it is sensed by the level sensor 21 which then delivers a signal for closing the contact R-a and energizing the relay coil X2. Thus the contact X2-b of the coil is opened and the coil 52 PJ of the electromagnetic contactor associated with the hot water pump 20 is deenergized so that the operation of the pump 20 is discontinued. Since the E2 level sensing end of the level sensor 21 is positioned above an inlet 18*a* of the hot water service circuit 18, there is no risk that air be entrained in the water supplied by the hot water pump 20.

It may be seen from the foregoing that the present invention provides for good separation between the hot water storage phase and the heating/cooling phase by means of the first program timer. Thus, hot water storage operation may be performed during the time of the day that heating/cooling is not necessary due to reduced heating/cooling load. Hot water may be supplied during heating/cooling operation by suitably setting the second program timer.

Therefore, the operating ratio of the heat pump type chilling unit may be elevated and the heating/cooling as well as service of hot water may be realized with an improved efficiency. Moreover, when the water level in the reservoir has decreased to lower than a predetermined level, the control circuit of the hot water pump is opened for interlocking the pump in the inoperative state. Thus there is no risk that the water in the reservoir be depleted resulting in air being entrained in the water delivered by the pump and consequent troubles in the supply of hot water.

In addition, since the third program timer is set so that the time hot water is available from the cock is directly followed by the time fresh water is replenished into the reservoir, hot water can positively be supplied during the hot water service time zone without any risk that insufficiently heated water be supplied to hot water service spots. Furthermore, since the control circuit for the hot water pump is rendered inoperative at the start of the water replenishing time zone as set by the third program timer, the operation of the hot water pump is discontinued at this time. In this manner, there is no risk that insufficiently heated water be supplied to hot water service spots even in case of malfunction or incorrect setting of the third program timer.

What is claimed is:

1. A combined heating/cooling and hot water service system comprizing a heat pump type chiller unit designed to effect a cooling cycle and a heating cycle, a water circuit communicating with a water-side heat exchanger of the chiller unit, a heat exchanger in said water circuit, adapted for supplying hot water, a fan coil unit for heating/cooling the room, said fan coil unit communicating with said water circuit and connected in parallel with said heat exchanger adapted for supplying hot water, changeover valves for selectively switching said water circuit for cooperation with said heat exchanger adapted for supplying hot water or with said fan coil unit, a reservoir for hot water having a water heating circuit placed in heat exchange relation with said heat exchanger for supplying hot water, a hot water service circuit for supplying the hot water from said reservoir to hot water service spots through said hot water pump, a first program timer operable for setting a hot water storage time zone in which the changeover valves are switched so that the heat exchanger adapted for supplying hot water comes into operation and hot water is stored through said water heating circuit in said reservoir, said first program timer being further operable for setting a heating/cooling time zone in which the changeover valves are switched so that the fan coil unit comes into operation for heating or cooling the room, and a second program timer operable for setting a hot water service time zone which is included in said heating/cooling time zone and in which said hot water pump is activated for serving the hot water from said reservoir through said hot water service circuit.

2. The combined heating/cooling and hot water service system as claimed in claim 1 further comprizing switching means for opening a control circuit of the hot water pump by operation of a level sensor in said reservoir.

3. The combined heating/cooling and hot water service system as claimed in claim 1 further comprizing a third program timer for setting a time that valve means in a water replenishment circuit are opened after lapse of the hot water service time zone set by the second program timer so that fresh water may be replenished into said reservoir.

4. The combined heating/cooling and hot water service system as claimed in claim 3 further comprizing switching means activated by said third program timer upon start of the time zone for fresh water replenishment set by said third program timer for opening the control circuit for said hot water pump.

* * * * *